US006811100B2

(12) United States Patent
Bardinet et al.

(10) Patent No.: US 6,811,100 B2
(45) Date of Patent: Nov. 2, 2004

(54) TELESCOPIC SPRAY ARM

(75) Inventors: Francois d' Assise Marie Santiago Bardinet, Brussels (BE); Jelle Dankert Vuijk, Rome (IT); John Russell Lawson, Rome (IT)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/397,655

(22) Filed: Mar. 26, 2003

(65) Prior Publication Data

US 2003/0189109 A1 Oct. 9, 2003

Related U.S. Application Data

(63) Continuation of application No. 09/831,481, filed on May 9, 2001, now abandoned, which is a continuation of application No. PCT/US99/25523, filed on Oct. 29, 1999.

(30) Foreign Application Priority Data

Nov. 9, 1998 (EP) ..... 98870245

(51) Int. Cl.[7] ..... B05B 15/06

(52) U.S. Cl. ..... 239/532; 239/530; 239/525; 239/280; 239/281; 239/357; 239/197

(58) Field of Search ..... 239/532, 357, 239/280.5, 281, 525, 526, 530, 165, 373, 195, 196, 197; 248/333

(56) References Cited

U.S. PATENT DOCUMENTS

| | | | | | |
|---|---|---|---|---|---|
| 1,554,746 | A | * | 9/1925 | Meinel | 239/281 |
| 1,745,972 | A | * | 2/1930 | Beck | 239/532 |
| 3,881,209 | A | | 5/1975 | Reinitz et al. | |
| 4,013,225 | A | * | 3/1977 | Davis | 239/281 |
| 4,202,068 | A | | 5/1980 | Lester et al. | |
| 4,270,238 | A | | 6/1981 | Shallenberg et al. | |
| 4,412,656 | A | * | 11/1983 | Beck | 239/281 |
| 4,457,472 | A | * | 7/1984 | Geberth, Jr. | 239/281 |
| 4,652,024 | A | * | 3/1987 | Krohn | 239/165 |
| 4,655,394 | A | * | 4/1987 | Ferrazza et al. | 239/412 |
| 4,989,295 | A | | 2/1991 | Guhne et al. | |
| 5,186,392 | A | | 2/1993 | Pleshek | |
| 5,390,695 | A | * | 2/1995 | Howard | 239/281 |
| 5,598,598 | A | * | 2/1997 | Sorenson | 15/144.4 |
| 6,390,335 | B1 | * | 5/2002 | Lawson et al. | 222/153.13 |
| 6,578,224 | B1 | * | 6/2003 | Lawson et al. | 8/158 |
| 6,595,437 | B1 | * | 7/2003 | Lawson et al. | 239/119 |

FOREIGN PATENT DOCUMENTS

| | | |
|---|---|---|
| FR | 2053474 | 4/1971 |
| FR | 2676376 | * 11/1992 |

* cited by examiner

*Primary Examiner*—Dinh Q. Nguyen
(74) *Attorney, Agent, or Firm*—Jeffrey V. Bamber; Kim William Zerby; Steven W. Miller

(57) ABSTRACT

The invention is an extendible liquid-applying spray arm for use with a liquid source, such as an electrical sprayer. It includes one handle and at least two tubular members which are telescopingly engaged with and slideable along one another. Sliding the tubular members extends/retracts the spray arm respectively for treating/storage or to meet particular work needs which require that said extendible spray arm has a short length. When the spray arm is collapsed, the telescopic members are at least partially arranged within the handle, so that the global length of the spray arm is less than the additional lengths of the handle and the telescopic portion. The spray arm further comprises a spray member for spraying the liquid. A flexible tube extends around the tubular members and connects to the nozzle member, which is preferably coiled around the tubular members.

12 Claims, 4 Drawing Sheets

TELESCOPIC SPRAY ARM

CROSS REFERENCES TO RELATED APPLICATIONS

This application is a continuation of U.S. patent application Ser. No. 09/831,481 filed May 9, 2001, now abandoned, which is a continuation of PCT Patent Application No. US 99/25573, filed Oct. 29, 1999, which claims the benefit of the filing date of European Patent Application No. 98870245.2, filed Nov. 19, 1998.

FIELD OF THE INVENTION

The present invention relates to a leak tight telescopic spray arm to apply to a spray device.

BACKGROUND OF THE INVENTION

Leak tight telescopic spray arms to apply to an electrical sprayer for use for household purposes are representative of the various telescopic spray arms to which the present invention can apply; such telescopic spray arms are typically made out of at least two portions which are movably connected one to the other. A dispensing hollow tube is attached to said portions for conducting a liquid product or a gas from a source, for example a container, to a dispensing hole, for example a spray nozzle.

Such spray arms are required because certain household operations, particularly those involving at-home cleaning, require that the cleaning device is convenient and ergonomic to use, and as compact as possible when arranged in a cupboard. Especially the spray arm must be collapsible so that it allows the user to clean a large area with the minimum of movements for example while cleaning a carpet, and reach difficult area such as ceilings, or area under heavy furniture. This spray arm must be designed such that it allows convenient use without forcing the user to bend over the task.

Clearly, such equipment has a significant impact upon the thoroughness of the household operation and upon the ease and efficiency with which workers perform it, and the equipment must be reliable.

While the products of earlier designers of household tools have been generally satisfactory, they are characterized by certain disadvantages. For example, in a tube-like extendible spray arm, a way to provide pressurized liquid from its proximal end to the nozzle at the distal end is to fill the entire spray arm with such liquid. In effect, the spray arm becomes its own tube.

For telescoping devices, so-called "dynamic" seals (e.g., sliding or rotating seals) are required to seal in liquid and avoid leaks even though device components move with respect to one another. Such seals are significantly more complex than static seals. Where the spray arm includes rigid, telescoping tubes providing the user with a substantial "reach," the weight of the confined liquid becomes significant. The user is apt to tire more quickly. Furthermore, spray arm disassembly and storage becomes a problem since it must first be emptied of liquid. Another disadvantage of some prior art tools is that they fail to recognize that tool users may clean areas very near by or at some considerable distance away. Certain of such tools fit one situation or the other—but not both.

Examples of prior art tools (not necessarily having the above-noted deficiencies) are described in the following patents. U.S. Pat. No. 4,202,068 (Lester) shows a pneumatically-powered scrubbing tool fed by a straight length of compressed air supply tube. An extension support pole fits over the main support pole and can be extended to a pre-selected position. The entire extension pole is rotated to lock relative pole positions. U.S. Pat. No. 4,989,295 (G ühne et al.) describes a telescopic wand having a short, coiled internal electrical cable which accommodates extension. The two tubes can be positionally adjusted one to the other in steps. U.S. Pat. No. 4,270,238 (Shallenberg et al.) shows a cleaning tool particularly adapted to ceiling and wall cleaning. The tool is a "dual-path" structure in that it applies a cleaning liquid through a brush and almost immediately after application, draws dirty liquid away using a vacuum-induced air stream. U.S. Pat. No. 3,881,209 (Reinitz et al.) shows a machine for spray cleaning ceiling tiles by feeding them through the machine after they are removed from their mounting grids.

In U.S. Pat. No. 5,186,392 (D1), a telescopic extension is described which comprises a coiled tubing inside the wand. However, with such an internal construction, the diameter of the wand jeopardizes the compactness of the appliance, as the internal diameter of the extension has to be relatively large. Although such a design makes the telescopic extension leak-tight, it is not convenient for an "every-day usage", especially when being handled by women, nor is it convenient to arrange in small storage area as home cupboards.

In U.S. Pat. No. 4,412,656 (D2), a telescopic device for dispensing a liquid is provided which comprises a handle, a telescopic extension, and a tubing for conducting the liquid to dispense. Said tubing is coiled outside said telescopic extension. However, in the device of D2, the telescopic extension is still an additional part to the handle., which leads to additional length when said device is in its compact configuration. Thus, there is still a need for a device with improved compactness when in the collapsed configuration, which would keep at least the same functionality when extended compared to the existing devices.

OBJECTS OF THE INVENTION

It is an object of this invention to provide an improved liquid-applying spray arm which is light in weight, compact in length and diameter when in the collapsed configuration for storage, and long enough to allow precise reach of large area to treat, particularly when said area are ceilings, carpets, or area located under furniture.

Another object of this invention is to provide an improved liquid-applying spray arm which is easy to manipulate, even when fully extended.

Still another object of this invention is to provide an improved liquid-applying spray arm obviating the need for dynamic seals.

Yet another object of this invention is to provide an improved liquid-applying spray arm useful in treating surfaces "close in" and farther away from the device user.

Another object of this invention is to provide an improved liquid-applying spray arm having an overall length adjustable in a continuum to any of an infinite number of positions.

Another further object of the present invention is to provide an improved liquid-applying spray arm which allows the user to easily control the flow of product which is dispensed.

SUMMARY OF THE INVENTION

The invention is an improvement in an extendible elongate liquid-applying spray arm for treating surfaces with such products as cleaning or laundry products, or perfumes.

The improvement includes at least two tubular members which are telescopingly engaged with and slideable along one another. Sliding the tubular members extends/retracts the spray arm respectively for treating/storage or to meet particular work needs which require that said extendible spray arm has a short length. More importantly, when the spray arm of the present invention is in the collapsed configuration, the telescopic members of the extendible segments are at least partially arranged within the handle, so that the global length of the spray arm is less than the additional lengths of the handle and the telescopic portion. The distal tubular member, i.e. the tubular member which is opposed to the extendible device's handle has a distal end with a nozzle member secured at such end. A flexible tube extends around the tubular members and connects to the nozzle member. Preferably, the flexible tube is coiled around the tubular members. The tube extends unbroken along the length of the first and second tubular members, from the proximal end to the distal end, to provide discharge from the nozzle member regardless of relative positions of the tubular members.

BRIEF DESCRIPTION OF THE DRAWINGS

The invention will now be explained in detail with reference to the following accompanying figures which are referred to as.

DETAILED DESCRIPTION OF THE INVENTION

Figure 1:
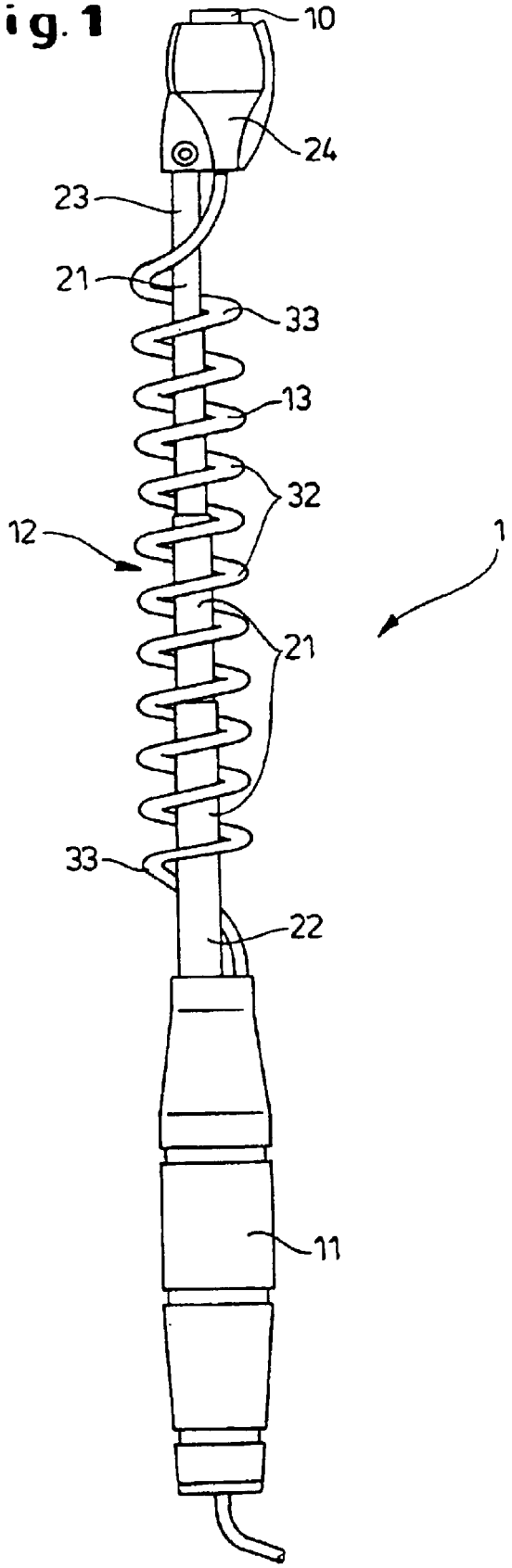
FIG. 1: which is a profile view showing the liquid-applying spray arm with tubing coiled outside the telescopingly extendible wand, said spray arm being in the extended configuration.
Figure 2:
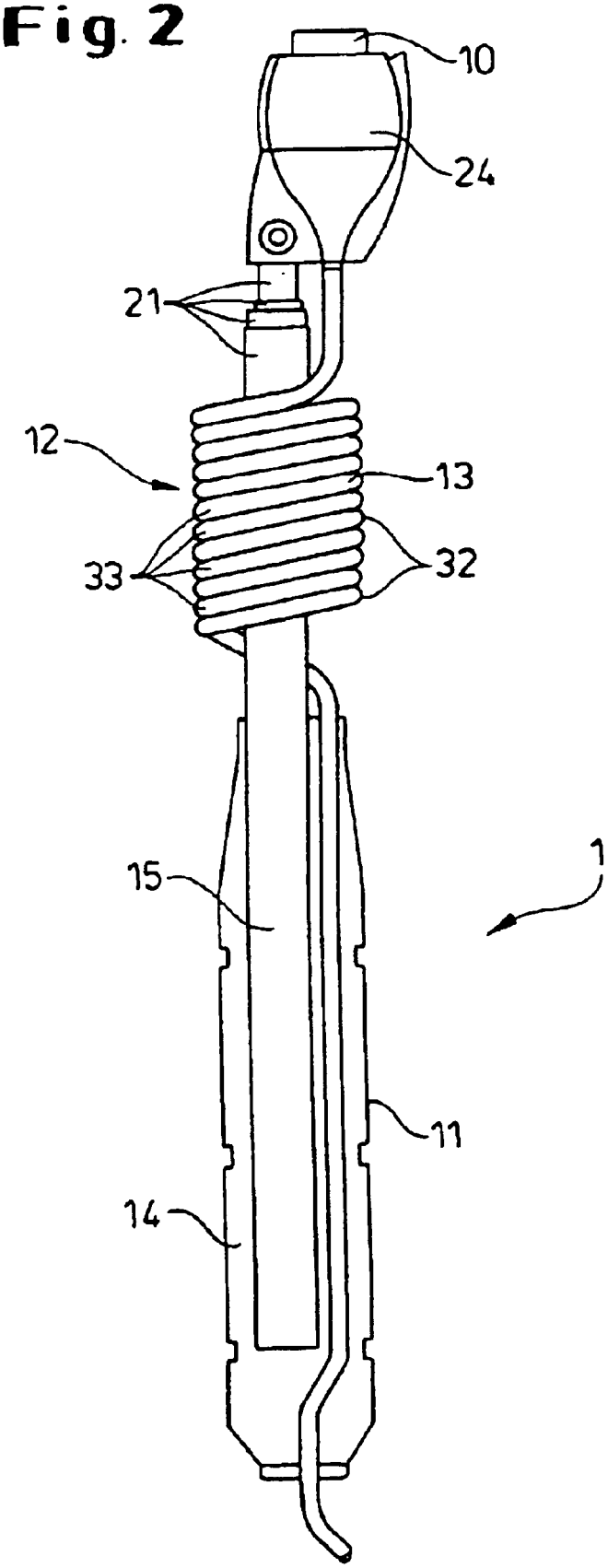
FIG. 2: which is a profile view showing the liquid-applying spray arm with tubing coiled outside the telescopingly extendible wand, said spray arm being in the collapsed configuration.

The FIGS. 1 and 2 show the extendible elongate liquid-applying spray arm (1) according to the invention, which is intended for use with a spray dispenser for applying a liquid solution, for example cleaning or laundry solutions, or perfumes, to large area. In a preferred embodiment of the present invention, the spray arm (1) is for use with an electrical sprayer for in-home cleaning usage. As described in detail below, the length of the spray arm (1) is adjustable and it preferably comprises a spray nozzle member which can optionally be oriented optimally to spray said cleaning solution on the surfaces to treat. The spray arm (1) is particularly useful in treating surfaces which tend to be damaged, or are difficult to treat by wiping, such as for example fabric surfaces as curtains, or carpets. The spray arm (1) may also be adapted such that special devices as brushes or cleaning pads to be moistened, for example for cleaning walls or ceilings.

In a preferred embodiment of the present invention, the spray arm (1) is to be connected to a liquid dispenser, which is more preferably an electrical sprayer. Said electrical sprayer comprises for example one container for containing a liquid solution, a pump for dispensing the liquid from the container to the dispensing end of the spray arm (1) through a dispensing tube (13), and a rechargeable battery for providing a portable and integrated source of energy.

The liquid can be of any nature whose dispensing requires the use of a sprayer, for example cleaning or laundry products, or perfumes. In a preferred embodiment of the present invention, said liquid is a liquid cleaning composition for use on fabrics. The cleaning products useful in the present invention can comprise various active components. The most useful components include surfactant; builders; bleach and bleach activators; enzymes and enzyme stabilizers; soil release agents, chelating agents; anti-redeposition agents; aqueous or non aqueous dispersing agents; brightener; suds suppressor; dye transfer inhibiting agents. Non-limiting examples of surfactants useful herein typically at levels from about 1% to about 55%, by weight, include the conventional $C_{11}$-$C_{18}$ alkyl benzene sulfonates ("LAS") and primary, branched-chain and random $C_{10}$-$C_{20}$ alkyl sulfates ("AS"), the $C_{10}$-$C_{18}$ secondary (2,3) alkyl sulfates of the formula $CH_3(CH_2)_x(CHOSO_3\text{-}M^+)$ $CH_3$ and $CH_3(CH_2)_y(CHOSO_3\text{-}M^+)$ $CH_2CH_3$ where x and (y+1) are integers of at least about 7, preferably at least about 9, and M is a water-solubilizing cation, especially sodium, unsaturated sulfates such as oleyl sulfate, the $C_{10}$-$C_{18}$ alkyl alkoxy sulfates ("$AE_xS$"; especially EO 1–7 ethoxy sulfates), $C_{10}$-$C_{18}$ alkyl alkoxy carboxylates (especially the EO 1–5 ethoxycarboxylates), the $C_{10\text{-}18}$ glycerol ethers, the $C_{10}$-$C_{18}$ alkyl polyglycosides and their corresponding sulfated polyglycosides, and $C_{12}$-$C_{18}$ alpha-sulfonated fatty acid esters. If desired, the conventional nonionic and amphoteric surfactants such as the $C_{12}$-$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), $C_{12}$-$C_{18}$ betaines and sulfobetaines ("sultaines"), $C_{10}$-$C_{18}$ amine oxides, and the like, can also be included in the overall compositions. The $C_{10}$–$C_{18}$ N-alkyl polyhydroxy fatty acid amides can also be used. Typical examples include the $C_{12}$–$C_{18}$ N-methylglucamides. See WO 9,206,154. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing. $C_{10}$–$C_{20}$ conventional soaps may also be used. If high sudsing is desired, the branched-chain $C_{10}$–$C_{16}$ soaps may be used. Mixtures of anionic and nonionic surfactants are especially useful. Other conventional useful surfactants are listed in standard texts.

The extendible spray arm (1) comprises a handle (11), to which is connected an telescopingly extendible wand (12) of the spray arm, and a dispensing tube (13) which is movably attached to said spray arm (1). Preferably, the spray arm (1) further comprises a dispensing nozzle, which is more preferably a spraying nozzle (10). All of these parts, and the way they are connected to each other will be now further described hereafter.

The spray arm (1) of the present invention is constructed as described below, and so that the length of the telescopingly extendible wand (12) is reduced to less than 15 cm, preferably less than 10 cm, more preferably less than 7 cm, when it is in collapsed configuration, while said telescopingly extendible wand (12) can be extended to more than 50 cm, preferably more than 70 cm when the spray arm (1) is in its fully extended configuration. At the same time, the external and greatest diameter of the spray arm (1) does not exceed 5 cm, preferably not more than 3.5 cm.

The spray arm (1) firstly comprises a handle (11), as shown in FIGS. 1 and 2, which is the most proximal element of said spray arm (1), i.e. the element which is the closest from the user during use. It has an elongate shape, and can be made out of any suitable material such as plastic, metal, alloy, cork, or a combination of several materials, but preferably, the external surface of the handle (11) is coated with an anti-slip, rubber-like material. In a preferred embodiment of the present invention, the handle (11) comprises a hollow portion (14) inside which the dispensing tube (13) is positioned. This hollow portion (14) is a cylindrical channel whose diameter is slightly superior to the external diameter of the dispensing tube (13). This channel is more preferably located along the great length of the handle (11). Preferably, the handle's length is less than 20 cm, more preferably less than 15 cm.

Once the dispensing tube (13) of the spray arm (1) is connected to the source of liquid, for example an electrical sprayer, the spray arm (1) can be detached from said source of liquid before use, or alternatively, it can stay attached to said source of liquid, for example, it can be used while integrated to said electrical sprayer's main body.

The handle (11) comprises a recess into which at least one portion (15) of the telescopingly extendible wand (12) is located when the spray arm (1) is in its collapsed configuration, as shown in FIG. 2. Preferably, the length of the telescopingly extendible wand's portion which is protruding from the handle (11), when said telescopingly extendible wand (12) is in full collapsed position, i.e. the portion which is not arranged within said handle (11), is less than 50%, preferably less than 25%, of the total length of said telescopingly extendible wand (12) in collapsed position. In this way, while the user benefits from the complete length of the telescopingly extendible wand (12), i.e. the substantially combined length of all segments of said telescopingly extendible wand (12), she/he can benefit from a collapsed spray arm (1) with a very short length.

Optionally, and while the spray arm (1) is framed such as to be as light as possible, the handle (11) comprises a counterweight which is either a separate element which is releasably connected, for example clipped or screwed, to said handle (11), or which is integrated to said handle (11). Said counterweight may be useful in case the weight of the device's distal end increases, for example when in extended position, and/or during use when the dispensing tube (13) is filled with liquid.

Optionally, the spray arm (1) further comprises a means (16) for controlling the flow of liquid which is dispensed through the nozzle member (10). Preferably, the flow-control means (16) is integrated to the handle (11), however, it can also be integrated to the main body of the liquid dispenser, for example to the main body of an electrical sprayer.

In a first embodiment of the present invention. the flow-control means (16) hats the shape of a turning piston (17) which is pierced by a channel (18) through which the liquid is free to flow. The turning piston (17) is rotateably inserted into a cylinder (19), as shown in FIGS. 5A to 5D). The flow-controlling means (16) is further provided with rings (20) for leak-tightness which are made for example out of a natural or synthetic rubber-based material, or Teflon®. The cylinder (19) is connected to the dispensing tube (13), such that when the channel (18) of the turning piston (17) is aligned with the tube, the flow-control means (16) is in its full dispensing position. When the user turns the piston into the cylinder (19), the flow of liquid is reduced, or even completely stopped when the channel (18) is substantially perpendicular to the alignment of the dispensing tube (13). In a second embodiment of the present invention, the flow-control means (16) is a cam-like rotating element which position is modified by action on an associated button. It is located on the outside of the dispensing tube (13), while said dispensing tube (13) is made of an elastically deformable material. Such a construction does not require to interrupt the continuity of the dispensing tube (13), thus improving the leak-tightness of the system. The cam-like element is a substantially oval rotating roller which comprises a central rotating axis disposed perpendicular to the direction of the dispensing tube (13). When the longitudinal direction of the cam is substantially parallel to the direction of the dispensing tube (13), the liquid is free to flow through the dispensing tube (13). As soon as the user turns the button, the longitudinal direction of the cam-like element is substantially perpendicular to the direction of the dispensing tube (13), then the dispensing tube (13) is compressed and closed such as to stop the liquid flow.

The telescopingly extendible wand (12) of the spray arm (1) comprises a series of at least two tubular members (21) movably connected one to the others. For clarity purposes in the following description, it is defined that the spray arm (1) is oriented and comprises a proximal end, near the handle (11), and a distal end to which the liquid product is dispensed. The tubular members (21) can have any shape which allows to connect them so as to build a rod-like extension which can be extended or collapsed by sliding one member relatively to the preceding one. Any material may be used which provide enough resistance to flexion, while being as light as possible. Such suitable materials include for example thermoplastic resins, metals, alloys, wood fiber, carbon fiber, or a blend of these. In a preferred embodiment of the present invention, the tubular members (21) are made out of metal.

Each tubular member (21) is telescopingly engaged with and slideable along the adjacent tubular members. Preferably, each tubular member (21) is shaped such as to be free to slide inside the preceding tubular member, and such that the following tubular member is free to slide into. However, the tubular members (21) can be "positionally reversed" such that each tubular member slides along the outside of the preceding tubular member. Sliding one tubular member inward or outward with respect to the adjacent tubular members retracts or extends the telescopingly extendible wand (12) of the spray arm (1) for storage or for cleaning and to meet particular work needs.

For some tasks, the user must be able to use the spray arm (1) in intermediate lengths. For that purpose, the number of tubular members (21) is preferably more than three, more preferably more than five. In a first embodiment of the present invention, the tubular member's diameter and profile are so adjusted that, while one member is free to slide relatively to the adjacent ones, the friction coefficient between two connected members requires a certain strength to make them slide and they are not free to slide only with their own weight. Rather, the user must apply a certain strength to make them slide, and once they are set in a determined length, the friction is enough to maintain this position during use or transportation. Suitable values for the friction coefficient and suitable profile and diameter for the tubular members will be chosen adequately by those skilled in the art.

At last, in any of the preceding embodiments of the present invention, at least one portion of the proximal segment of the telescopingly extendible wand (12) of the spray arm (1) is designed to fit inside the handle (11) when the spray arm (1) is in the collapsed configuration. Preferably, the length of the telescopingly extendible wand's portion which is protruding from the handle (11), when said telescopingly extendible wand (12) is in full collapsed position, i.e. the portion which is not arranged within said handle (11), is less than 50%, preferably less than 25%, of the total length of said telescopingly extendible wand (12) in collapsed position.

The last tubular member (23), i.e. the tubular member which is the nearest from the distal end of the spray arm (1), has a distal end with one or more, preferably one nozzle member (10) secured at such end. Preferably, the nozzle member is a spray nozzle (10) selected so that the sprayed product takes the form of a continuous stream or film, or of a discontinuous stream or film of fine particles, or of a mist, or of a foam. It is most preferred that the spray pattern is in the form of fine particles because this is the most efficient way to cover a large surface area with a small volume of product with an even coverage. In particular the spray pattern may be a flat spray, taking the form of a triangle with its apex at the nozzle, or it may take the form of a conical spray, again with its apex at the nozzle. The spray can be created, for example, by an impinchment type of nozzle, or by using spinner technology, or an oscillating fluid circuit. Other embodiments include a foaming nozzle or a deflection nozzle. Typically the product output is from about 20 ml/minute to about 400 ml/minute, and preferably from about 150 ml/minute to about 250 ml/minute for carpet cleaning. It is preferred that the telescopingly extendible wand (12) of the spray arm (1) has one nozzle, but it may also have multiple nozzles located along its length. Optionally, the nozzle member is detachable and can be replaced by another nozzle member for which the spray pattern is different. This allows the user to selectively chose the spray pattern relatively to the surface to clean. In this case, the nozzle member is secured onto the distal tubular member of the spray arm's telescopingly extendible wand (12) by screwing, clipping or any other releasable means.

Optionally, the spraying nozzle (10) is mounted to the telescopingly extendible wand's distal segment (23) by a rotary attaching means, for example a ball/socket joint, so that said spraying nozzle (10) can be manually oriented by the user to facilitate access to surfaces to whom the access is difficult.

In a preferred embodiment of the present invention, the spray arm (1) is provided with an anti-dripping valve (24). At the time the user stops feeding the dispensing tube (13) with liquid, for example by stopping the pump of an electrical sprayer, there is still liquid in the tube. As a result, the liquid which remains in the tube is very likely to be spilled when the user moves the spray arm (1), or when the user collapses the telescopingly extendible wand (12) to arrange the spray arm (1). Such spillage is clearly undesirable, and it is prevented by the use of the anti-dripping valve (24). Said valve is preferably located in the distal portion of the spray arm (1), more preferably connected between the dispensing tube (13) and the nozzle member. Several anti-dripping valve (24) constructions may be applied in the present invention.

Figure 3A:
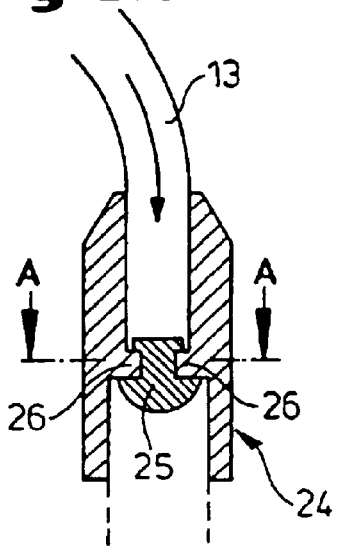
FIGS. 3A–B–C: which are profile cut views of the anti-dripping system with umbrella valve.
Figure 3B:
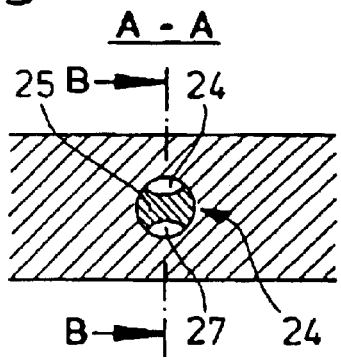
Figure 3C:
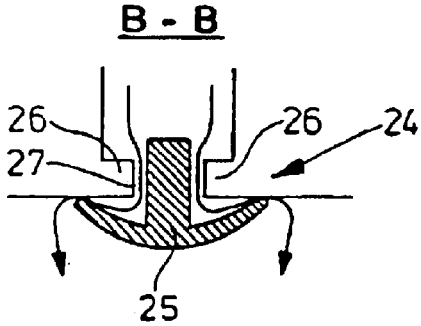

In a first embodiment, the anti-dripping valve (24) is an umbrella (25) valve, as shown in FIGS. 3A and 3B, which is integrated into a channel and secured in place by a portion (26) of the channel which has a restricted diameter. As shown in FIG. 3B, the central portion of the valve comprises liquid channels (27) through which the liquid is free to flow. As shown in FIG. 3C, the umbrella (25) portion of the valve is curved and flexible, and so positioned that it normally contacts the walls of the channel. As a result, the liquid has to deform said flexible umbrella (25) portion to flow. Such deformation can be achieved for example by pumping the liquid from the container of an electrical sprayer, however, as soon as the pump is stopped, the liquid charge inside the dispensing tube (13) is not sufficient to deform the umbrella (25), the valve closes back, and the liquid flow is stopped.

Figure 4A:
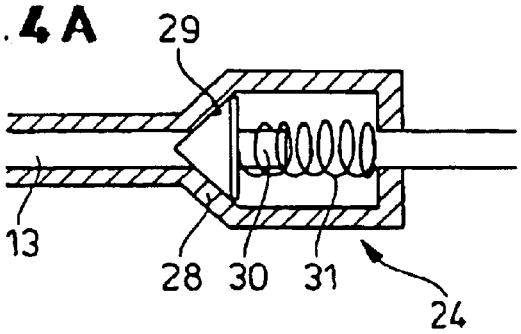
FIGS. 4A–B: which are profile cut views of the anti-dripping system with cone and spring elements, respectively in closed and open positions.
Figure 4B:
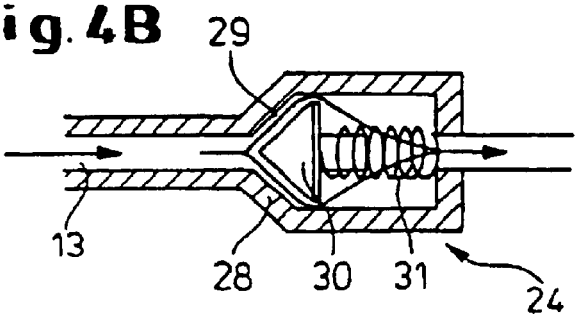
Figure 5A:
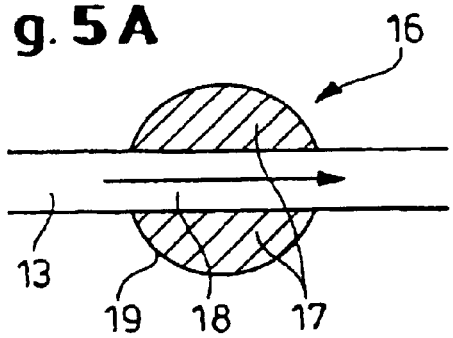
FIGS. 5A–B–C: which are profile cut views of the flow-control means with cylinder system, respectively in open, reduced-flow, and closed positions.
Figure 5B:
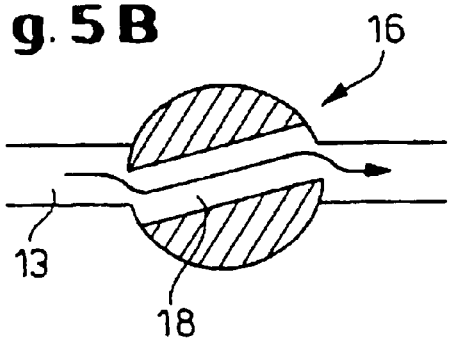
Figure 5C:
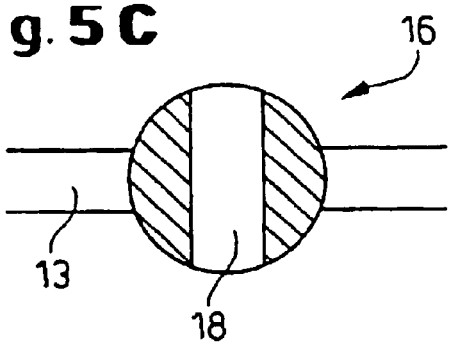
FIG. 5D: which is a schematic profile view showing the cylinder in place in its housing with rubber joints for leak-tightness positioned on the sides, and the flow-control rotating button.
Figure 5D:
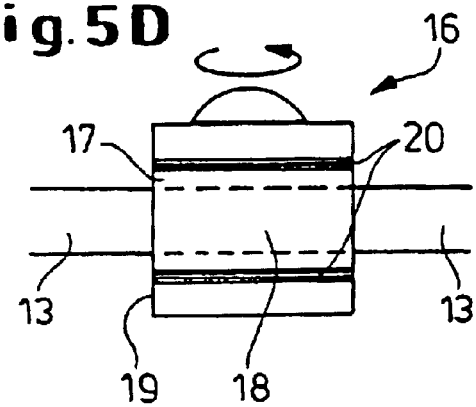

In a second embodiment of the present invention and as shown in FIGS. 4A and 4B, the valve comprises a rigid housing (28), which comprises a hollow portion with a conic wall (29). Inside the housing is also a movable cone (30), and a spring element (31) which elastically presses the cone against the conic wall (29) of the housing such as to create a liquid-tight and releasable seal. The cone is positioned so as to face the liquid flow. When the liquid charge inside the dispensing tube (13) is sufficient, for example, when the liquid is pumped from the container of an electrical sprayer, the movable cone (30) is pushed by the liquid and passes through the valve up to the nozzle member of the spray arm (1). As soon as the liquid charge inside the tube is not sufficient, for example when the pump of the electrical sprayer is stopped, the cone is pressed back against the conic wall (29) of the housing by the spring, and the liquid flow is stopped.

The spray arm (1) further comprises a dispensing tube (13) which conducts the liquid to dispense from a source, for example the container or bottle of an electrical sprayer, up to the nozzle member of the spray arm (1) to which it is connected in a liquid flow communication. The dispensing tube (13) is attached in at least one point to the spray arm (1). It can be of any suitable material such as for example a thermoplastic resin, natural or synthetic rubber, a metal or an alloy, or a combination of the preceding materials. Preferably, the dispensing tube (13) extends unbroken along the length of the spray arm (1), from the proximal end to the distal end. More preferably, said dispensing tube (13) is unbroken from the source of liquid, up to the nozzle member, as shown in FIG. 2. Such arrangement provides an effective cleaning solution discharge from the nozzle member regardless of relative positions of the tubular members one to the other, while providing the user with a leak-tight liquid applying spray arm (1).

In a first and preferred embodiment of the present invention, the dispensing tube (13) is attached inside the handle (11) as shown in FIG. 2, said dispensing tube (13) then comprises a coiled portion which is coiled outside the telescopingly extendible wand (12) of the spray arm (1). Preferably, said coiled portion comprises at least 10 coils (32). The distal portion of the tube is connected to the nozzle member (10) through a liquid-tight connection. The liquid flow is substantially the same in collapsed, extended or intermediate positions of the spray arm (1).

In a second embodiment of the invention, the dispensing tube (13) is linear and preferably made out of a non-extendible thermoplastic material. It is connected to the source of liquid, for example to the container of an electrical sprayer by its proximal end. Said dispensing tube (13) is further connected to the spray arm (1) by fish-rod like attachments, preferably in at least one point of each tubular member, as shown in figure. Alternatively, the dispensing tube (13) can be attached only to the source of liquid, to the handle (11) of the spray arm (1), and then to the nozzle member, but without or only partial link to the telescopingly extendible wand (12) of the spray arm (1). Partial link means that the tube is attached in one or two points only to the extendible portion of the spray arm (1). Such fish-rod like attachments comprise for example annular rings (20) made out of metal, plastic or a combination of those, through which the tube is free to slide when the spray arm (1) is extended or retracted. The distal end of the tube is connected in a leak-tight way to the nozzle member of the spray arm (1).

In a third embodiment of the present invention, the dispensing tube (13) is linear and made out of a rubber-like material, preferably silicone rubber. This material gives the tube enough flexibility, so that when the spray arm (1) is extended, the dispensing tube (13) elastically extends as well, but its diameter stays substantially the same. As a result, the liquid flow through the nozzle member remains substantially the same when the spray arm (1) is in collapsed, extended, or intermediate position.

From the foregoing, it will be appreciated that the quantity of relatively heavy cleaning solution confined within the relatively small diameter dispensing tube (13) is reduced. Furthermore, the materials which are chosen for making the different elements of the spray arm (1) are light. As a result, the weight of the spray arm (1) is thereby minimized and said spray arm (1) is very easy and less-tiring to manipulate, even over long periods of time, especially when handled by women. Preferably the weight of the spray arm is less than 200 g, more preferably less than 150 g.

What is claimed is:

1. A compact extendible liquid-applying spray arm for allowing a user to dispense a liquid product from a source of liquid, said spray arm comprising a handle, a telescopingly extendible wand separate from said handle and connected to said handle, and a dispensing tubing, a portion of said dispensing tubing being attached outside said extendible wand, wherein said extendible spray arm is capable of extending between a collapsed position and an extended position, and at least a portion of the telescopingly extendible wand is arranged inside the handle when the compact spray arm is in the collapsed position.

2. A spray arm according to claim 1 wherein said telescopingly extendible wand has a length, and the length of the telescopingly extendible wand's portion which is protruding from the handle when said telescopingly extendible wand is in full collapsed position, is less than 50% of the total length of said telescopingly extendible wand in collapsed position.

3. A spray arm according to claim 1 wherein the largest diameter of said extendible wand is smaller than 5 cm.

4. A spray arm according to claim 1 wherein the dispensing tube is coiled around said telescopingly extendible wand.

5. A spray arm according to claim 1 wherein said spray arm comprises a dispensing end comprising a spray nozzle.

6. A spray arm according to claim 1 wherein said spray arm comprises a dispensing end comprising a foaming nozzle.

7. A spray arm according to claim 1 which comprises an anti-dripping valve for preventing that liquid contained in the dispensing tube from being spilled when the source of liquid is cut and the spray arm is being manipulated.

8. A spray arm according to claim 1 wherein the liquid flows in the dispensing tube when liquid is being dispensed, and said spray arm comprises a flow-control means to allow the user to regulate flow of dispensed liquid.

9. A spray arm according to claim 1 which is to be fitted onto an electrical sprayer used for household cleaning purposes.

10. A spray arm according to claim 1 wherein the dispensing tube is made of a stretchable material, so that it can be elastically elongated when the wand is in the extended position and retracted when the wand is in the collapsed position.

11. A spray arm according to claim 1 wherein said portion of the telescopingly extendible wand that is arranged inside the handle when the compact spray arm is in the collapsed position comprises an outermost portion of said extendible wand, and said extendible wand comprises tubular members that are at least partially disposed inside said outermost portion of said extendible wand when the compact spray arm is in the collapsed position, wherein outermost portion of said extendible wand is in a fixed position inside said handle.

12. A spray arm according to claim 1 wherein said handle comprises a hollow portion inside of which a portion of said dispensing tubing is positioned.

* * * * *